US005368507A

United States Patent [19]

Harris

[11] Patent Number: 5,368,507

[45] Date of Patent: Nov. 29, 1994

[54] PADDLE BOARD

[76] Inventor: Herman R. Harris, 305 Idlewood Dr., Kannapolis, N.C. 28083

[21] Appl. No.: 139,534

[22] Filed: Oct. 19, 1993

[51] Int. Cl.[5] ..... B63H 16/20

[52] U.S. Cl. ..... 440/29; 440/95

[58] Field of Search ..... 440/21, 26–31, 440/90–93, 95, 96, 97

[56] References Cited

U.S. PATENT DOCUMENTS

| | | | |
|---|---|---|---|
| 876,133 | 1/1908 | Beebe | 440/30 |
| 1,071,113 | 8/1913 | Teters | 440/27 |
| 1,578,584 | 3/1926 | Cromer | 440/27 |
| 1,729,974 | 10/1929 | Watson | 440/27 |
| 3,779,202 | 12/1973 | Martin et al. | 440/27 |
| 4,162,788 | 7/1979 | Turnier . | |
| 4,772,237 | 9/1988 | Zalkauskas | 440/96 |
| 4,984,648 | 1/1991 | Strzok | 440/97 |

FOREIGN PATENT DOCUMENTS

| | | | |
|---|---|---|---|
| 408131 | 3/1910 | France | 440/96 |
| 989871 | 9/1951 | France | 440/97 |
| 2270905 | 12/1975 | France | 440/26 |

*Primary Examiner*—Jesus D. Sotelo

*Attorney, Agent, or Firm*—Bell, Seltzer, Park & Gibson

[57] ABSTRACT

A recreational paddle board is provided having a floating board, a substantially flat board portion and two paddle drives affixed thereto. A drive shaft has pedals rotatably mounted thereto so that the user may rotate the paddle drives. Each paddle drive includes first and second cranks and an endless flexible member, having a plurality of paddles hingedly affixed thereto, is entrained around the cranks. The paddles are engaged by fixed paddle guide element along the lower run of the flexible member so that, when the drive shaft is pedalled, the paddles generate a reactive thrust only in the desired linear direction. Each paddle drive also includes speed conversion device which changes the rotational speed of the flexible member relative to the drive shaft. In a first preferred embodiment, the substantially flat portion comprises a buoyant foam or plastic panel. In second and third preferred embodiments, the substantially flat portion comprises a net and air mattress respectively. Side rails are adjustable to accommodate users of various heights and include locking hinges to allow easy storage of the paddle board.

23 Claims, 3 Drawing Sheets

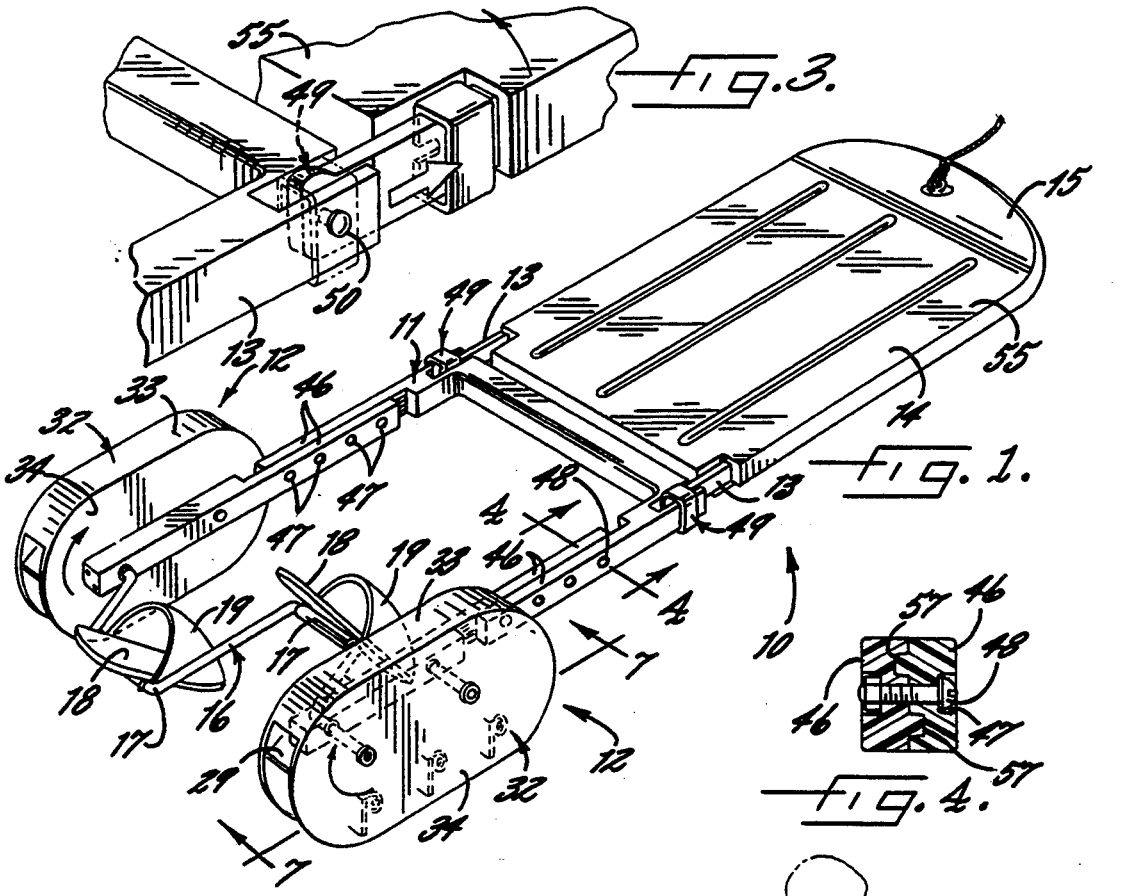
Fig. 3.
Fig. 1.
Fig. 4.
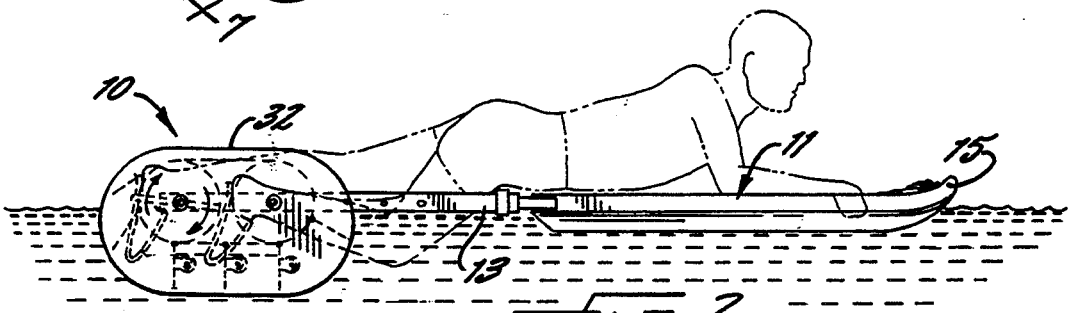
Fig. 2.
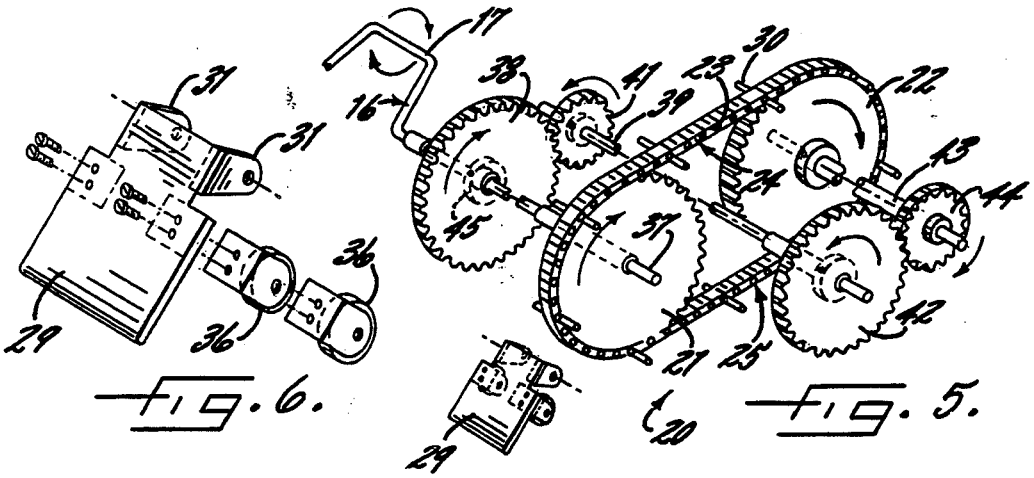
Fig. 6.
Fig. 5.

PADDLE BOARD

FIELD OF THE INVENTION

The present invention relates to a recreational water apparatus and more particularly to a paddle board.

BACKGROUND OF THE INVENTION

Various recreational water devices are available that allow users to mechanically propel themselves along the surface of bodies of water such as lakes and swimming pools. Such devices provide the user with a means of enjoying the water and a pleasurable method of exercising.

For example, U.S. Pat. No. 4,772,237 to Zalkauskas discloses a paddle boat having a closed loop flexible member with a plurality of paddles pivotally connected thereto. The user sits on the boat and rotates the pedals which advances the flexible member and propels the boat forward. The paddle boat, however, does not allow the user to have direct contact with the water. Further, a paddle stop attached to each paddle requires a large clearance above the upper run of the flexible member, which makes the drive apparatus bulky.

U.S. Pat. No. 3,779,202 to Martin et al. discloses a manually propelled water craft upon which the user lies prone and cranks a paddle wheel to move the craft forward. Rotation of a crank with the hands, however, is not a comfortable or powerful motion and prevents the user from resting on his elbows when propelling the water craft.

U.S. Pat. Nos. 1,578,584 and 1,071,113 to Cromer and Teters respectively disclose swimming appliances wherein the user lies prone and pedals to propel the appliance. The Cromer '584 patent incorporates two paddle wheels for propulsion whereas the Teters '113 patent uses a single propeller. Both appliances are complex and have exposed moving parts that could injure the user or other swimmers. In addition, the rotational speed of the paddle wheels and propeller are substantially equivalent to the rotational speed of the pedals, which limits the maximum attainable linear speed of the appliances.

It is an object of the present invention to provide a recreational water apparatus that overcomes the deficiencies of the prior art.

It is another object of the present invention to provide a paddle board that allows the user to operate the paddle board in a comfortable and efficient position.

It is yet another object of the present invention to provide a paddle board wherein the linear speed of the paddle board is not limited by the rotational speed of the pedals.

It is yet another object to provide a paddle board with a compact and lightweight drive mechanism in which moving parts are enclosed to avoid injuring the user.

SUMMARY OF THE INVENTION

These and other objects and advantages of the present invention are achieved in the embodiments illustrated herein by the provision of an apparatus which comprises a recreational paddle board having a floating board and two paddle drives affixed thereto.

The floating board has a substantially flat portion for receiving the body of a user and has sufficient buoyancy for retaining the board and user at the surface of a body of water, such as a pool or lake. A drive shaft is rotatably mounted to the board and has two offset portions on which pedals are mounted for receiving the feet of a user lying in a prone position. In this position, the user may rotate the drive shaft which in turn rotates the paddle drives.

The paddle drives include first and second cranks, at least one of which is driven by the drive shaft. An endless flexible member, such as a roller chain, is entrained around the cranks so that the flexible member has upper and lower substantially horizontal runs extending between the cranks. A plurality of paddles is hingedly affixed to the flexible member so that the paddles may move between an extended position directed away from the flexible member and a retracted position adjacent the flexible member.

Fixed paddle guide means extend from the board beneath the cranks and the lower run of the flexible member. The guides engage the paddles along the lower run so as to retain the paddles in the extended position. Thus, when the drive shaft is pedalled, the extended paddles move along the lower run to generate a reactive thrust in the desired linear direction for propelling the paddle board. When the paddles are disengaged from the guides along the upper run of the flexible member the paddles hingedly move to the retracted position so that the reactive thrust and extension of the retracted paddles moving along the upper run is minimized.

The paddle board may also include speed conversion means which causes the flexible member to rotate at a speed different from that of the drive shaft. Speed conversion means includes a first support shaft rotatably mounted to the board which supports an input gear and also rotatably supports the first crank. A second support shaft is rotatably mounted to the board and supports first and second intermediate gears. The first intermediate gear is driven by the input gear. A third support shaft is rotatably mounted to the board and supports an output gear and the second crank, the output gear being driven by the second intermediate gear. Thus, the pedalled rotation of the drive shaft causes the input gear to drive the first intermediate gear, which causes the second support shaft to drive the second intermediate gear, which causes the second intermediate gear to drive the output gear, which causes the third support shaft to drive the second crank.

A unidirectional clutch may be disposed between the drive shaft and the paddle drive such that rotation of the drive shaft will cause the flexible member to rotate only in the desired rotational direction, whereby reactive thrust will be generated only in the desired linear direction.

The floating board may include two generally parallel side rails such that the substantially flat portion for receiving the body of the user is disposed between the rails. In the first preferred embodiment, the substantially flat portion comprises a buoyant foam or plastic panel. In the second and third preferred embodiments, the substantially flat portion comprises a net and air mattress, respectively. Each of the side rails further includes a locking hinge whereby the paddle board can be folded at the hinges when unlocked.

The side rails have two linear sections having corresponding tongue and groove faces and a number of evenly spaced apart and corresponding holes. A removable pin extends between at least one corresponding hole in each section so that the length of the paddle board can by adjusted by removing the pin, sliding the sections relative to each other until a desired pair of corresponding holes are aligned, and reinserting the pin into the aligned holes.

BRIEF DESCRIPTION OF THE DRAWINGS

Some of the objects and advantages of the present invention having been stated, others will appear as the description proceeds when taken in conjunction with the accompanying drawings, in which FIG. 1 is a perspective view of a first embodiment of the paddle board of the present invention;

FIG. 2 is an environmental side elevation of the paddle board, illustrating the position of a user thereon;

FIG. 3 is an enlarged and fragmentary view of the paddle board, illustrating the locking hinge of a side rail;

FIG. 4 is a sectional view of a side rail taken along line 4—4 in FIG. 1 and illustrating the corresponding tongue and groove faces and pin of the linear sections;

FIG. 5 is an enlarged and exploded view of the speed conversion means of the paddle board;

FIG. 6 is a greatly enlarged and exploded view of one of the paddles and rollers affixed thereto;

DETAILED DESCRIPTION OF THE PREFERRED EMBODIMENTS

Figure 7:
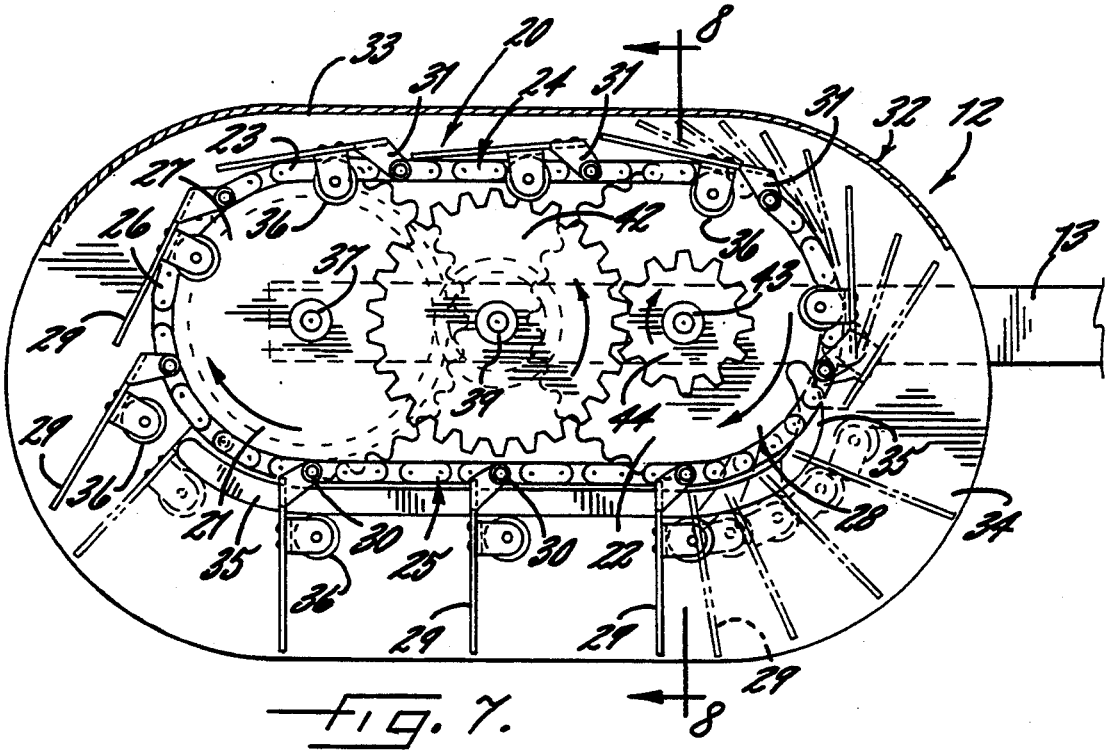
FIG. 7 is a sectional elevation view of the paddle drive of the paddle board taken along line 7—7 of FIG. 1 and illustrating the hinged rotation of the paddles.

Referring more particularly to the drawings, FIG. 1 shows one embodiment of a recreational paddle board 10 of the present invention having a floating board means 11 and two paddle drives 12 affixed thereto.

The floating board 11 includes two generally parallel side rails 13 that define a longitudinal direction and a substantially flat portion 14 disposed between the side rails 13 at the forward end of the board 11. The user of the paddle board 10 lies prone on the substantially flat portion 14 as shown in FIG. 2. The board 10 and substantially flat portion 14 are preferably made of a non-corrosive and buoyant material, such as plastic, and have sufficient buoyancy for supporting the board 10 and user at the surface of a body of water, such as a pool or lake. The substantially flat portion 14 also includes a bow 15 which may be slightly upturned to minimize drag on the paddle board 10 when advancing through the water and to assure that the board 10 rides over surface disturbances such as small waves in the water.

A drive shaft 16 is rotatably mounted between the side rails 13 at the rear end of the board 10. The drive shaft 16 has two offset portions 17 on which pedals 18 are mounted for receiving the feet of the user. The pedals 18 include toe covers 19 so that the user'a feet will not slip when pedalling. Therefore, the user lies prone on the substantially flat portion 14 in a position that allows a comfortable yet powerful pedalling action.

The rotary action of the drive shaft 16 is transmitted through a speed conversion means 20, as more fully explained below, to the two paddle drives 12 mounted on the outside of each side rail 13. Referring now to FIG. 7, each paddle drive 12 includes first and second cranks 21, 22, at least one of which is driven by the drive shaft 16, that are rotatably mounted in alignment with each other on the respective side rail 13. An endless flexible member 23 is entrained around the cranks 21, 22 so that the flexible member 23 has upper and lower substantially horizontal runs 24, 25 extending between the cranks 21, 22. In the illustrated embodiment, the endless flexible member 23 comprises a roller chain 26 and the cranks 21, 22 comprise roller chain sprockets 27, 28, although it would be readily apparent to one of ordinary skill in the art that other flexible members and cranks could be used, such as belts and pulleys.

A plurality of paddles 29 is hingedly affixed to the flexible member 23. In the illustrated embodiment, extended roller pins 30 extend from each side of the roller chain 26 and support two hinge arms 31 on each paddle 29, as best shown in FIG. 5. Thus, the paddles 29 may move between an extended position directed away from the flexible member and generally perpendicular thereto and a retracted position adjacent the flexible member and generally parallel thereto.

As best seen in FIGS. 1 and 7, a paddle drive housing 32 having a top face 33 and two parallel side faces 34 is mounted to each side rail 13 of the board 10 and substantially covers the upper run 24 and sides of the respective paddle drive 12. The top face 33 of the paddle drive housing 32 is mounted sufficiently close to the upper run 24 of the flexible member 23 so that the paddles 29 can only pass underneath the housing 32 in the retracted position so as to minimize the bulk associated with the housing 32. The bottom of the paddle drive housing 32 is open to allow the proper flow of water therethrough.

Paddle guides 35 are affixed to the inside of the side faces 34 of the paddle drive housing 32 at a position beneath the cranks 21, 22. The guides 35 extend generally parallel to and slightly below the lower run 25 of the flexible member 23, as best shown in FIG. 7. The forward portion of each paddle guide 35, however, has a smaller radius of curvature than the corresponding portion of the flexible member 23 so that the forward tip of the paddle guide 35 extends above the flexible member 23.

The paddle guides 35 engage the paddles 29 along the lower run 25 and retain them in the extended position by preventing their rotation relative to the flexible member 23. Thus, when the drive shaft 16 is pedalled, the extended paddles 29 move along the lower run 25 and generate a reactive thrust in the linear direction necessary to propel the paddle board 10.

Figure 8:
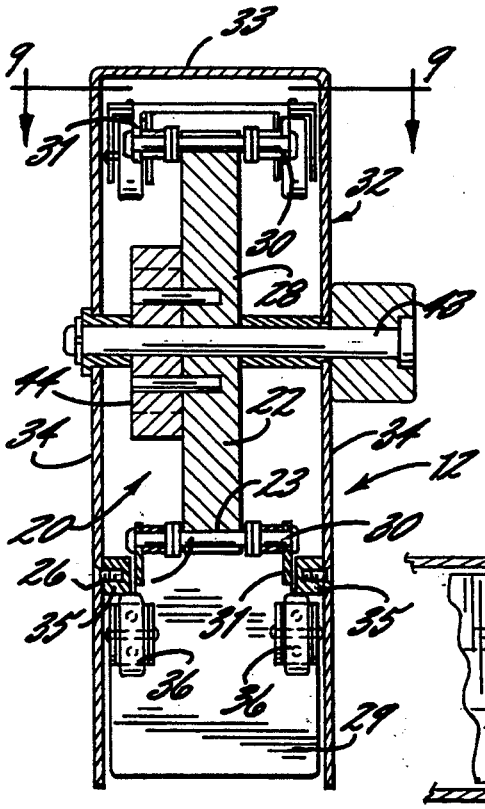
FIG. 8 is a sectional end view of the paddle drive taken along line 8—8 of FIG. 7.
Figure 9:
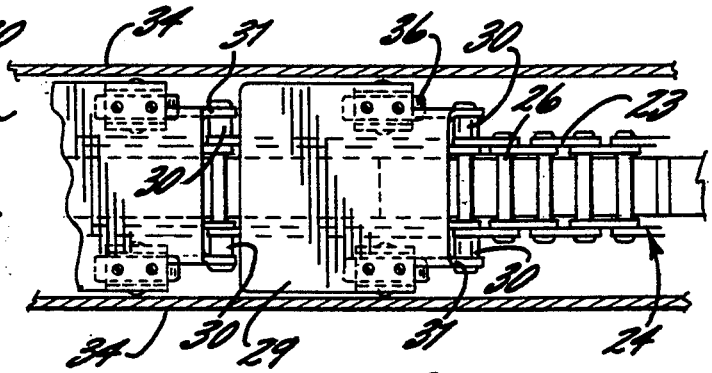
FIG. 9 is a sectional top view of the paddle drive illustrating the paddles in the retracted position.

When the paddles 29 reach the rear end of the lower run 25, they are disengaged from the paddle guide 35 and hingedly pivot, in the rotational direction opposite to the rotational direction of the flexible member 23, to the retracted position, as best shown in FIG. 7. Therefore, the paddles 29 travel along the upper run 24 of the flexible member 23 in the retracted position, as shown in FIGS. 8 and 9. Although the upper run 24 of the flexible member 23 is not ordinarily submerged below the water line, as shown in FIG. 2, the upper run 24 may be submerged on occasion. Thus, the retracted position of the paddles 29 will minimize any reactive thrust in the undesired direction. Also, movement of the paddles 29 along the upper run 24 in the retracted position reduces the clearance necessary between the upper run 24 and the top face 33 of the housing 32 so that the housing 32 may be made relatively compact.

When the paddles 29 approach the front end of the upper run 24, they hingedly pivot from the retracted to the extended position, as is best shown in FIG. 7, in the rotational direction corresponding to that of the flexible member 23. A pair of rollers 36 is affixed to each paddle 29, as best shown in FIG. 6, to engage the respective paddle guide 35. Once a roller 36 has passed the tip of the paddle guide 35 it engages the paddle guide 35 and the paddles 29 are firmly held in the extended position, as shown in FIG. 8, to maximize the reactive thrust in the desired direction.

Rollers 36 are employed to ensure smooth engagement of the paddles 29 although it would be readily apparent to one of ordinary skill in the art that a simple shoulder or other abutment face (not shown) attached to the paddles could be employed in lieu of the rollers 36. Alternatively, the paddle guides 35 could include a plurality of small rollers (not shown) to ensure smooth engagement of the paddles 29.

The paddle board 10 also includes speed conversion means 20 in each paddle drive 12 which causes the flexible member 23 to rotate at a speed different from the drive shaft 16. The speed conversion means 20 includes a first support shaft 37 which is connected to the drive shaft 16 and which is rotatably mounted to the rear end of the respective side rail 13. The first support shaft 37 supports an input gear 38 and rotatably supports the first crank 21 so that the first crank 21 is free to rotate independently of the shaft 16. A second support shaft 39 is rotatably mounted to the side rail 13 ahead of and in longitudinal alignment with the first support shaft 37 and supports first and second intermediate gears 41, 42. The first intermediate gear 41 is positioned so as to be engaged by the input gear 38. A third support shaft 43 is rotatably mounted to the side rail 13 ahead of and in longitudinal alignment with the second support shaft 39. The third support shaft 43 supports the second crank 22 and an output gear 44 that is positioned to be engaged by the second intermediate gear 42. Thus, the pedalled rotation of the drive shaft 16 causes the input gear 38 to drive the first intermediate gear 41, which causes the second support shaft 39 to drive the second intermediate gear 42. The second intermediate gear 42 drives the output gear 44 which causes the third support shaft 43 to drive the second crank 22 and the flexible member 23.

It would be readily apparent to one of ordinary skill in the art that the relative gear sizes of the speed conversion means 20 could be varied to change the gear ratio, which is defined herein as the number of revolutions of the flexible member 23 for each revolution of the drive shaft 16. The following example provides 4.8 revolutions of the second crank 22 for each revolution of the drive shaft 16:

| Example | |
|---|---|
| Input Gear | 26 teeth |
| First Intermediate Gear | 10 teeth |
| Second Intermediate Gear | 26 teeth |
| Output Gear | 14 teeth |

-continued

| Example | |
|---|---|
| Second Crank | 25 teeth |
| First Crank | 25 teeth |

Therefore, with a roller chain having 46 one inch links, the above speed conversion means will result in a gear ratio of 2.6.

A unidirectional clutch 45 may be disposed between the drive shaft 16 and the input gear 38 of each paddle drive 12. The clutch 45 prevents the drive shaft 16 from driving the paddle drive 12 in the direction opposite to the desired rotational direction. Therefore, the flexible member 23 can rotate only in the desired rotational direction so that reactive thrust will be generated only in the desired linear direction.

To accommodate users of various heights, the distance between the pedals 18 and the substantially flat portion 14 can be adjusted. Each side rail 13 has two linear sections 46 having corresponding tongue and groove faces 57, as best shown in FIG. 4, and a number of evenly spaced apart and corresponding holes 47. At least one removable pin 48 extends between at least one corresponding hole 47 of each side rail 13 so that the length of the paddle board 10 can by adjusted by removing the pin 48 from the hole 47, sliding the linear sections 46 relative to each other in the longitudinal direction until a desired pair of corresponding holes 47 are aligned, and reinserting the pin 48 into the aligned holes 47.

Each of the side rails 13 may further include a locking hinge 49 whereby the paddle board can be folded at the hinges 49 when unlocked, as shown in FIG. 3. The hinge allows the board to be easily stored or placed in a car. The hinge 49 includes a hinge pin 50 that can be removed so that the substantially flat portion 14 of the board can be removed, as more fully discussed below.

Figure 10:
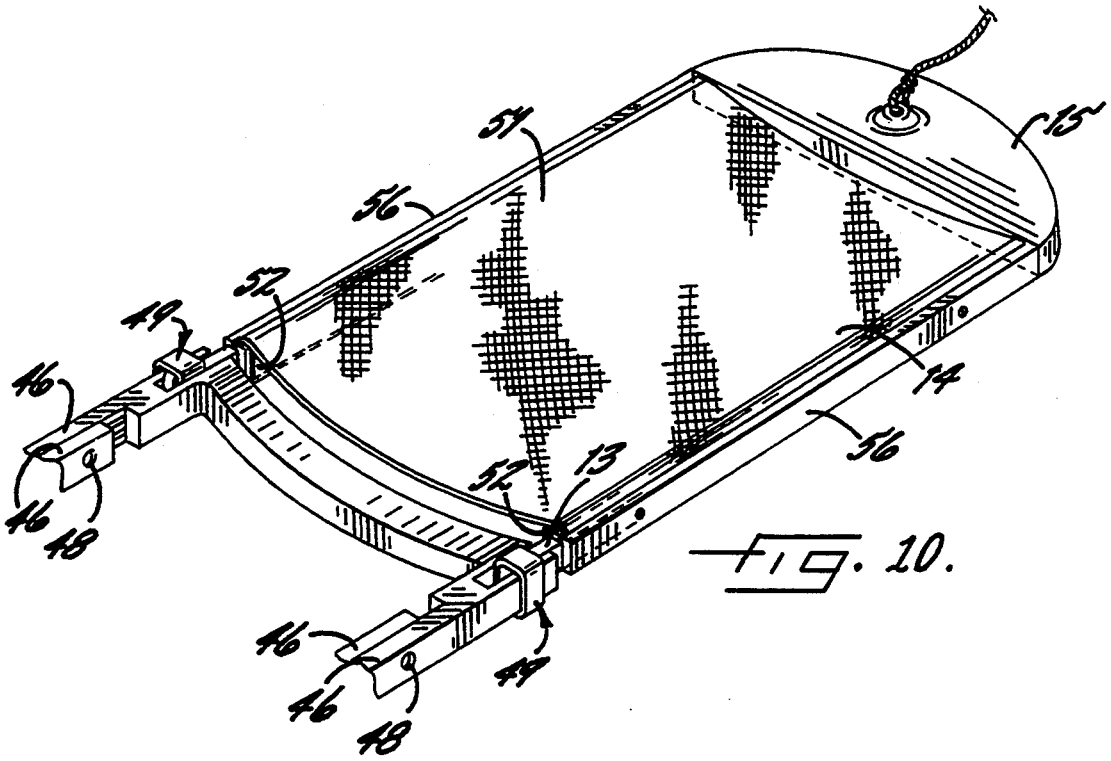
FIG. 10 is a perspective view of the substantially flat portion of a second embodiment of the present invention illustrating a net disposed between the side rails; and, FIG. 11 is a perspective view of the substantially flat portion of a third embodiment of the present invention illustrating an air mattress disposed between the side rails.

In a first preferred embodiment, the substantially flat portion 14 comprises a buoyant foam or plastic panel 55, as shown in FIGS. 1–3. In a second preferred embodiment, the substantially flat portion 14 comprises a net 51 having two sleeves 52 that are supported by the side rails 13, as shown in FIG. 10. A retaining strip 56 secures the net and sleeves 52.

Figure 11:
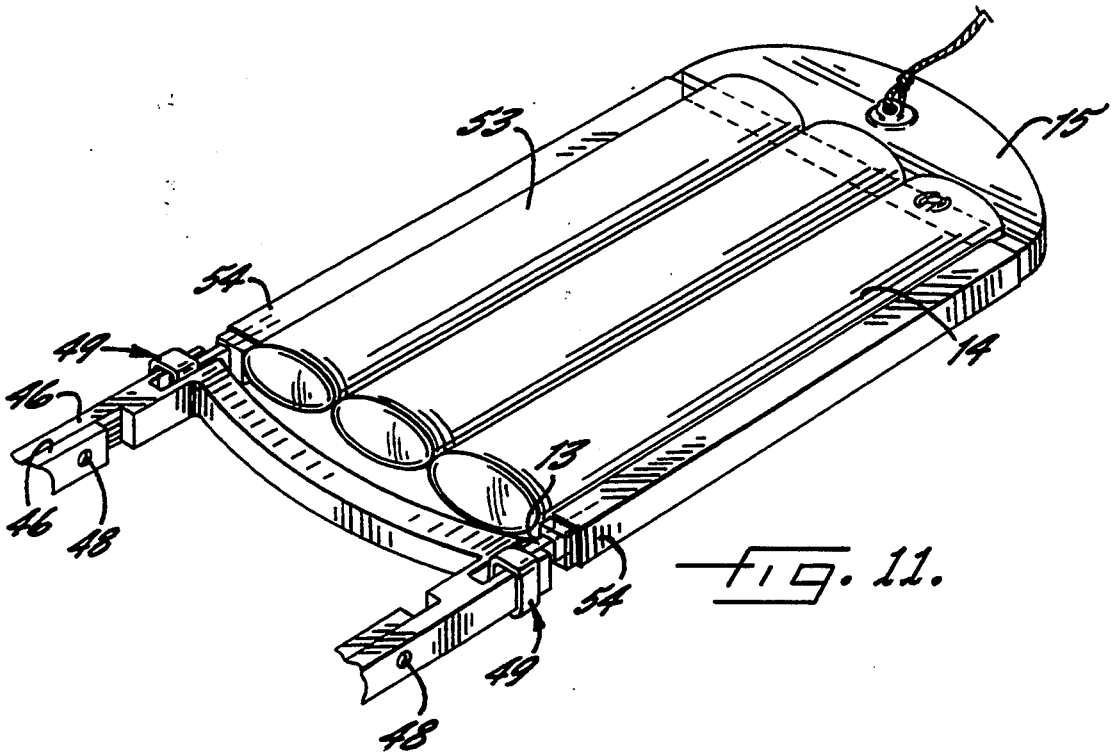

The substantially flat portion 14 of a third preferred embodiment comprises an air mattress 53 similarly having two sleeves 54 that are supported by the side rails 13, as shown in FIG. 11. To replace the substantially flat portion 14, the hinge 49 is unlocked and the hinge pin removed. The substantially flat portion 14 can then be easily removed by sliding it from the side rails 13 in the rearward direction. A new substantially flat portion 14 is installed by sliding the sleeves 52, 54 over the side rails 13 and reassembling the locking hinge 49.

In the drawings and specification, preferred embodiments of the invention have been illustrated and described, and although specific terms are employed, they are used in a generic and descriptive sense and not for purposes of limitation.

That which is claimed is:

1. A recreational paddle board, comprising:

floating board means having a substantially flat portion for receiving the body of a user;

a drive shaft rotatably mounted on said board means, said drive shaft having offset portions on which pedals are mounted for receiving the feet of the user so that the user may rotate said drive shaft; and at least one paddle drive affixed to said board means, said paddle drive including:

a plurality of cranks, at least one of said cranks being driven by said drive shaft;

an endless flexible member trained around said cranks and having upper and lower substantially horizontal runs extending between said cranks;

a plurality of paddles hingedly affixed to said flexible member such that said paddles may move between an extended position directed away from said flexible member and a retracted position adjacent said flexible member; and fixed paddle guide means extending from said board means beneath said cranks and said lower run of said flexible member for engaging said paddles along said lower run to retain said paddles in said extended position, and for disengaging said paddles along said upper run so that said paddles may hingedly move to said retracted position;

whereby pedalled rotation of said drive shaft causes said extended paddles moving along said lower run to generate a reactive thrust in a desired direction for propelling the paddle board, and further whereby the reactive thrust and extension of said retracted paddles moving along said upper run is minimized.

2. The paddle board of claim 1 further comprising speed conversion means driven by said drive shaft for transmitting rotary power from said drive shaft to said at least one driven crank.

3. The paddle board of claim 2 wherein said speed conversion means further comprises:

a first support shaft driven by said drive shaft, said first support shaft being rotatably mounted to said board means;

an input gear fixedly mounted on said first support shaft;

a second support shaft rotatably mounted to said board means;

first and second intermediate gears fixedly mounted on said rotatable second support shaft, said first intermediate gear being driven by said input gear; and a third support shaft rotatably mounted to said board means and supporting an output gear and said at least one driven crank, said output gear being driven by said second intermediate gear so as to transmit drive motion from said drive shaft to said driven crank.

4. The paddle board of claim 3 wherein said speed conversion means results in a gear ratio of between approximately two and three revolutions of said flexible member for each revolution of said drive shaft.

5. The paddle board of claim 1 wherein said endless flexible member comprises a roller chain.

6. The paddle board of claim 5 wherein said cranks comprise roller chain sprockets.

7. The paddle board of claim 1 wherein said floating board means comprises two generally parallel side rails and wherein said substantially flat portion for receiving the body of the user is supported between said side rails.

8. The paddle board of claim 7 wherein said substantially flat portion for receiving the body of the user comprises an air mattress.

9. The paddle board of claim 7 wherein said substantially flat portion for receiving the body of the user comprises a net.

10. The paddle board of claim 7 further comprising a locking hinge in each said side rail, whereby said hinges may be unlocked to permit folding of said paddle board and further whereby said hinges may be locked to retain said side rails in an extended position.

11. The paddle board of claim 7 wherein each said generally parallel side rail further comprises two linear sections having corresponding tongue and groove faces, each said section having a plurality of evenly spaced apart and corresponding holes, and at least one removable pin extending between at least one said corresponding hole in each said section, whereby the length of said paddle board can be adjusted by removing said pin from side holes, sliding said linear sections relative to each other until a desired pair of said corresponding holes are aligned, and reinserting said pin into said aligned holes.

12. The paddle board of claim 1 wherein each said paddle includes a roller for engaging said paddle guide means.

13. The paddle board of claim 1 further comprising a paddle drive housing mounted to said board means and substantially covering said upper run and sides of said paddle drive.

14. The paddle board of claim 1 further comprising a unidirectional clutch disposed between said drive shaft and said paddle drive such that rotation of said drive shaft will cause said flexible member to rotate only in a desired direction, whereby reactive thrust will be generated only in said desired direction.

15. A recreational paddle board, comprising:

floating board means having two generally parallel side rails defining a longitudinal direction and a substantially flat portion supported between said side rails for receiving the body of a user and having sufficient buoyancy for retaining the board and user at the surface of a body of water;

a drive shaft rotatably mounted on said board means and extending laterally between said side rails, said shaft having offset portions positioned between said side rails and on which pedals are mounted for receiving the feet of the user so that the user may rotate said drive shaft; and at least one paddle drive affixed to said side rails, said paddle drive including:

speed conversion means operatively connected to said drive shaft so as to be rotatably driven thereby;

a plurality of sprockets mounted for rotation about parallel laterally directed axes and being longitudinally aligned, at least one of said sprockets being operatively connected to said speed conversion means so as to be rotatably driven thereby;

a roller chain entrained around said sprockets and having upper and lower substantially horizontal runs extending in the longitudinal direction between said sprockets;

a plurality of paddles hingedly affixed to said roller chain such that said paddles may move between an extended position directed away from said roller chain and a retracted position adjacent said flexible roller chain;

a roller rotatably mounted on each said paddle; and fixed paddle guide means extending from said board means beneath said sprockets and said lower run of said roller chain for engaging said rollers of said paddles along said lower run to pivot said paddles from said retracted position to said extended position in a rotational direction corresponding to the rotational direction of said roller chain and to retain said paddles in said extended position, and for disengaging said rollers of said paddles along said upper run so that said paddles may pivot to said retracted position in the opposite rotational direction;

whereby pedalled rotation of said drive shaft causes said extended paddles moving along said lower run to generate a reactive thrust in a desired longitudinal direction for propelling the paddle board, and further whereby the reactive thrust and extension of said retracted paddles moving along said upper run is minimized.

16. The recreational paddle board of claim 15 wherein said speed conversion means further comprises:

a first support shaft driven by said drive shaft, said first support shaft being rotatably mounted to said board means;

an input gear fixedly mounted on said first support shaft;

a second support shaft rotatably mounted to said board means;

first and second intermediate gears fixedly mounted on said rotatable second support shaft, said first intermediate gear being driven by said input gear; and a third support shaft rotatably mounted to said board means and supporting an output gear and said at least one driven sprocket, said output gear being driven by said second intermediate gear so as to transmit rotary drive motion from said drive shaft to said driven sprocket.

17. The paddle board of claim 16 wherein said speed conversion means results in a gear ratio of between approximately two and three revolutions of said roller chain for each revolution of said drive shaft.

18. The paddle board of claim 15 wherein said substantially flat portion for receiving the body of the user comprises an air mattress.

19. The paddle board of claim 15 wherein said substantially flat portion for receiving the body of the user comprises a net.

20. The paddle board of claim 15 further comprising a locking hinge in each said side rail, whereby said hinges may be unlocked to permit folding of said paddle board and further whereby said hinges may be locked to retain said side rails in an extended position.

21. The paddle board of claim 15 wherein each said generally parallel side rail further comprises two linear sections having corresponding tongue and groove faces, each said section having a plurality of evenly spaced apart and corresponding holes, and at least one removable pin extending between at least one said corresponding hole in each said section, whereby the length of said paddle board can be adjusted by removing said pin from said holes, sliding said linear sections relative to each other until a desired pair of said corresponding holes are aligned, and reinserting said pin into said aligned holes.

22. The paddle board of claim 15 further comprising a paddle drive housing mounted to said board means and substantially covering said upper run and sides of said paddle drive.

23. The paddle board of claim 15 further comprising a unidirectional clutch disposed between said drive shaft and said paddle drive such that rotation of said drive shaft will cause said flexible member to rotate only in a desired direction, whereby reactive thrust will be generated only in said desired direction.

* * * * *

UNITED STATES PATENT AND TRADEMARK OFFICE

CERTIFICATE OF CORRECTION

PATENT NO. : 5,368,507

DATED : November 29, 1994

INVENTOR(S) : Herman R. Harris

It is certified that error appears in the above-identified patent and that said Letters Patent is hereby corrected as shown below:

Col. 3, line 67, "user'a" should be -- user's--.

Signed and Sealed this

Twelfth Day of December, 1995

*Attest:*

Bruce Lehman

BRUCE LEHMAN

*Attesting Officer*

*Commissioner of Patents and Trademarks*